US011560900B2

(12) United States Patent
Wilkes et al.

(10) Patent No.: US 11,560,900 B2
(45) Date of Patent: Jan. 24, 2023

(54) COMPRESSOR DRIVESHAFT ASSEMBLY AND COMPRESSOR INCLUDING SAME

(71) Applicant: Emerson Climate Technologies, Inc., Sidney, OH (US)

(72) Inventors: Jason Wilkes, Fair Oaks Ranch, TX (US); Zheji Liu, Tipp City, OH (US)

(73) Assignee: Emerson Climate Technologies, Inc., Sidney, OH (US)

( * ) Notice: Subject to any disclaimer, the term of this patent is extended or adjusted under 35 U.S.C. 154(b) by 304 days.

(21) Appl. No.: 16/946,173

(22) Filed: Jun. 9, 2020

(65) Prior Publication Data

US 2021/0381522 A1 Dec. 9, 2021

(51) Int. Cl.

| | |
|---|---|
| ***F04D 29/053*** | (2006.01) |
| ***F04D 29/28*** | (2006.01) |
| ***F04D 29/26*** | (2006.01) |
| ***F04D 29/051*** | (2006.01) |
| *F04D 29/056* | (2006.01) |

(52) U.S. Cl.

CPC ..... *F04D 29/266* (2013.01); *F04D 29/053* (2013.01); *F04D 29/0513* (2013.01); *F04D 29/284* (2013.01); *F04D 29/056* (2013.01); *F05D 2220/40* (2013.01); *F05D 2240/52* (2013.01); *F05D 2240/60* (2013.01); *F05D 2260/37* (2013.01)

(58) Field of Classification Search

CPC ..... F04D 29/0513; F04D 29/057; F04D 29/266

See application file for complete search history.

(56) References Cited

U.S. PATENT DOCUMENTS 4,986,733 A * 1/1991 Fleury ..... F04D 29/266 415/230

5,176,497 A 1/1993 Deacon et al.

(Continued)

FOREIGN PATENT DOCUMENTS

CN 1135305 C 1/2004
CN 102242730 A 11/2011

(Continued)

OTHER PUBLICATIONS

International Search Report and Written Opinion of the International Search Authority dated Sep. 8, 2021 issued in connection with PCT/US2021/035571 filed on Jun. 3, 2021; pp. 12.

*Primary Examiner* — Justin D Seabe
(74) *Attorney, Agent, or Firm* — Armstrong Teasdale LLP

(57) ABSTRACT

A compressor system includes a compressor housing and a driveshaft rotatably supported within the compressor housing. The compressor system further includes an impeller that imparts kinetic energy to incoming refrigerant gas upon rotation of the driveshaft, a thrust disk coupled to the driveshaft, and a bearing assembly mounted to the compressor housing. The impeller includes an impeller bore having an inner surface, and the thrust disk includes an outer disk and a hub. The bearing assembly rotatably supports the outer disk of the thrust disk. The hub is disposed within the impeller bore, and includes a hub outer surface in contact with the inner surface of the impeller bore. A first contact force between the hub outer surface and the inner surface of the impeller bore increases with increased rotational speed of the driveshaft.

20 Claims, 7 Drawing Sheets

(56) References Cited

U.S. PATENT DOCUMENTS

| | | | | |
|---|---|---|---|---|
| 5,741,116 | A | 4/1998 | Hudson | |
| 5,882,178 | A | 3/1999 | Hudson et al. | |
| 6,310,414 | B1 | 10/2001 | Agahi et al. | |
| 7,223,077 | B2 * | 5/2007 | Nishiyama | F04D 29/266 416/204 A |
| 8,061,970 | B2 | 11/2011 | Maier et al. | |
| 8,821,136 | B2 | 9/2014 | Komatsu et al. | |
| 9,157,447 | B2 | 10/2015 | Freeman et al. | |
| 9,243,645 | B2 | 1/2016 | Shinohara | |
| 10,072,707 | B2 | 9/2018 | Futae | |
| 10,415,599 | B2 | 9/2019 | Sun | |
| 2005/0232775 | A1 | 10/2005 | Thiele et al. | |
| 2008/0199326 | A1 | 8/2008 | Masoudipour et al. | |
| 2015/0275921 | A1 | 10/2015 | Pinkney et al. | |
| 2016/0097283 | A1 * | 4/2016 | Svihla | F02C 6/12 417/407 |
| 2017/0009780 | A1 | 1/2017 | Yano et al. | |
| 2019/0249682 | A1 | 8/2019 | Bonnefoi et al. | |
| 2019/0285091 | A1 | 9/2019 | Masuda | |
| 2021/0355956 | A1 * | 11/2021 | Donato | F04D 29/266 |

FOREIGN PATENT DOCUMENTS

| | | | |
|---|---|---|---|
| CN | 103362860 | A | 10/2013 |
| CN | 103201461 | B | 6/2015 |
| CN | 105386994 | A | 3/2016 |
| CN | 107222132 | A | 9/2017 |
| CN | 108138793 | A | 6/2018 |
| CN | 105317737 | B | 8/2018 |
| CN | 110017300 | A | 7/2019 |
| CN | 110439847 | A | 11/2019 |
| CN | 110469547 | A | 11/2019 |
| DE | 3528724 | A1 | 2/1987 |
| EP | 1429032 | B1 | 9/2007 |
| FR | 2685044 | A1 | 6/1993 |
| GB | 2462635 | A | 2/2010 |
| JP | 4255532 | A | 9/1992 |
| JP | 8226302 | A | 9/1996 |
| JP | 2006170403 | A | 6/2006 |
| JP | 2007303431 | A | 11/2007 |
| JP | 2010127240 | A | 6/2010 |
| JP | 2011202588 | A | 10/2011 |
| JP | 05108911 | B2 | 12/2012 |
| JP | 2013002466 | A | 1/2013 |
| JP | 05773806 | B2 | 9/2015 |
| JP | 05802599 | B2 | 10/2015 |
| JP | 05929157 | B2 | 6/2016 |
| JP | 2017145917 | A | 8/2017 |
| JP | 2019035435 | A | 3/2019 |
| JP | 2019158033 | A | 9/2019 |
| KR | 1004700 | B1 | 1/2011 |
| RU | 2012127256 | A | 1/2014 |
| WO | 2018154674 | A | 8/2018 |

* cited by examiner

COMPRESSOR DRIVESHAFT ASSEMBLY AND COMPRESSOR INCLUDING SAME

FIELD

The field of the disclosure relates generally to a driveshaft assembly for a compressor, and more particularly, to a driveshaft assembly including a thrust disk and an impeller for use in a compressor.

BACKGROUND

Recent CFC-free commercial refrigerant compositions, such as R134A, are characterized as having lower density compared to previously-used CFC or HCFC refrigerants such as R12. Consequently, an air conditioning system must process a higher volume of a CFC-free refrigerant composition relative to CFC or HCFC refrigerant to provide a comparable amount of cooling capacity. To process higher volumes of refrigerant, the design of a gas compressor may be modified to process refrigerant at higher operating speeds and/or operate with higher efficiency.

Centrifugal compressors that make use of continuous dynamic compression offer at least several advantages over other compressor designs, such as reciprocating, rotary, scroll, and screw compressors that make use of positive displacement compression. Centrifugal compressors have numerous advantages over at least some positive displacement compressor designs, including lower vibration, higher efficiency, more compact structure and associated lower weight, and higher reliability and lower maintenance costs due to a smaller number of components vulnerable to wear. High-capacity cooling systems employing centrifugal compressors operate a driveshaft at high-rotational speeds to transmit power from the motor to the impeller to impart kinetic energy to the incoming refrigerant. To mitigate the challenges associated with the high-rotational speed driveshafts, centrifugal compressors typically require relatively tight tolerances and high manufacturing accuracy. Additionally, other types of mechanical systems, such as motors, pumps, and turbines etc., also operate driveshafts at high-rotational speeds. As known to those familiar with these types of rotating mechanical systems, loosening and misalignment of components mounted to the driveshaft may occur during operation creating unbalanced loads which result in vibrations, subjecting the driveshaft to cyclic stress loadings, resulting in decreased operational lifespans and premature failures, particularly premature failure of bearings and seals.

Centrifugal compressors include one or more bearing assemblies which support and maintain alignment of the driveshaft. In typical centrifugal compressors, components, such as the impeller and the thrust disk, are separately coupled to the driveshaft using friction fit connections, e.g., such as a press fit or a shrink fit. The driveshaft, impeller, and the thrust disk, rotating at high-rotational speeds, induce centrifugal forces which increase with increased rotational speed. The centrifugal force is directed radially, away from the axis of rotation, pulling the components outward away from the driveshaft, loosening the friction fit connections. Furthermore, the inertia of the components, particularly radial distribution of mass extending away from the axis of rotation contributes to the centrifugal force further loosening the friction connections with the driveshaft. The loosening of connections creates eccentric loads such that the center of mass of the mounted component is not coincident with the axis of rotation of the driveshaft. The effects of eccentric loading are further exaggerated at high-rotational speeds resulting in vibrations that increase wear and may result in increased system downtime.

The design of mounted components on the high-rotational speed driveshaft pose an on-going challenge of maintaining the friction fit connections between the driveshaft and the components. Furthermore, maintaining alignment of the center of gravity of the components coincident with the axis of rotation of the driveshaft during high-rotational operating speeds facilitates avoiding eccentric loads that lead to vibrations which may damage components of the centrifugal compressor.

This background section is intended to introduce the reader to various aspects of art that may be related to various aspects of the present disclosure, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

SUMMARY

In one aspect, a compressor system includes a compressor housing and a driveshaft rotatably supported within the compressor housing. The compressor system further includes an impeller that imparts kinetic energy to incoming refrigerant gas upon rotation of the driveshaft, a thrust disk coupled to the driveshaft, and a bearing assembly mounted to the compressor housing. The impeller includes an impeller bore having an inner surface, and the thrust disk includes an outer disk and a hub. The bearing assembly rotatably supports the outer disk of the thrust disk. The hub is disposed within the impeller bore, and includes a hub outer surface in contact with the inner surface of the impeller bore. A first contact force between the hub outer surface and the inner surface of the impeller bore increases with increased rotational speed of the driveshaft.

In another aspect, a driveshaft assembly for a compressor includes a driveshaft, a thrust disk coupled to the driveshaft, and an impeller coupled to the thrust disk. The thrust disk includes an outer disk and hub, which includes a hub outer surface. The impeller includes an impeller bore having an inner surface. The hub of the thrust disk is disposed within the impeller bore, and the hub outer surface is in contact with the inner surface of the impeller bore. A first contact force between the hub outer surface and the inner surface of the impeller bore increases with increased rotational speed of the driveshaft.

In yet another aspect, a method of assembling a compressor includes coupling a thrust disk to a driveshaft by inserting the driveshaft into a thrust disk bore of the thrust disk. The method further includes coupling an impeller to the thrust disk by inserting a hub of the thrust disk into an impeller bore of the impeller such that an outer surface of the hub is in contact with an inner surface of the impeller bore and a first contact force between the hub outer surface and the inner surface of the impeller bore increases with increased rotational speed of the driveshaft. The method further includes mounting bearings to a compressor housing such that the bearings rotatably support an outer disk of the thrust disk.

Various refinements exist of the features noted in relation to the above-mentioned aspects. Further features may also be incorporated in the above-mentioned aspects as well. These refinements and additional features may exist individually or in any combination. For instance, various features discussed below in relation to any of the illustrated embodiments may be incorporated into any of the above-described aspects, alone or in any combination.

BRIEF DESCRIPTION OF THE DRAWINGS

The following figures illustrate various aspects of the disclosure.

Corresponding reference characters indicate corresponding parts throughout the drawings.

DETAILED DESCRIPTION

Figure 1:
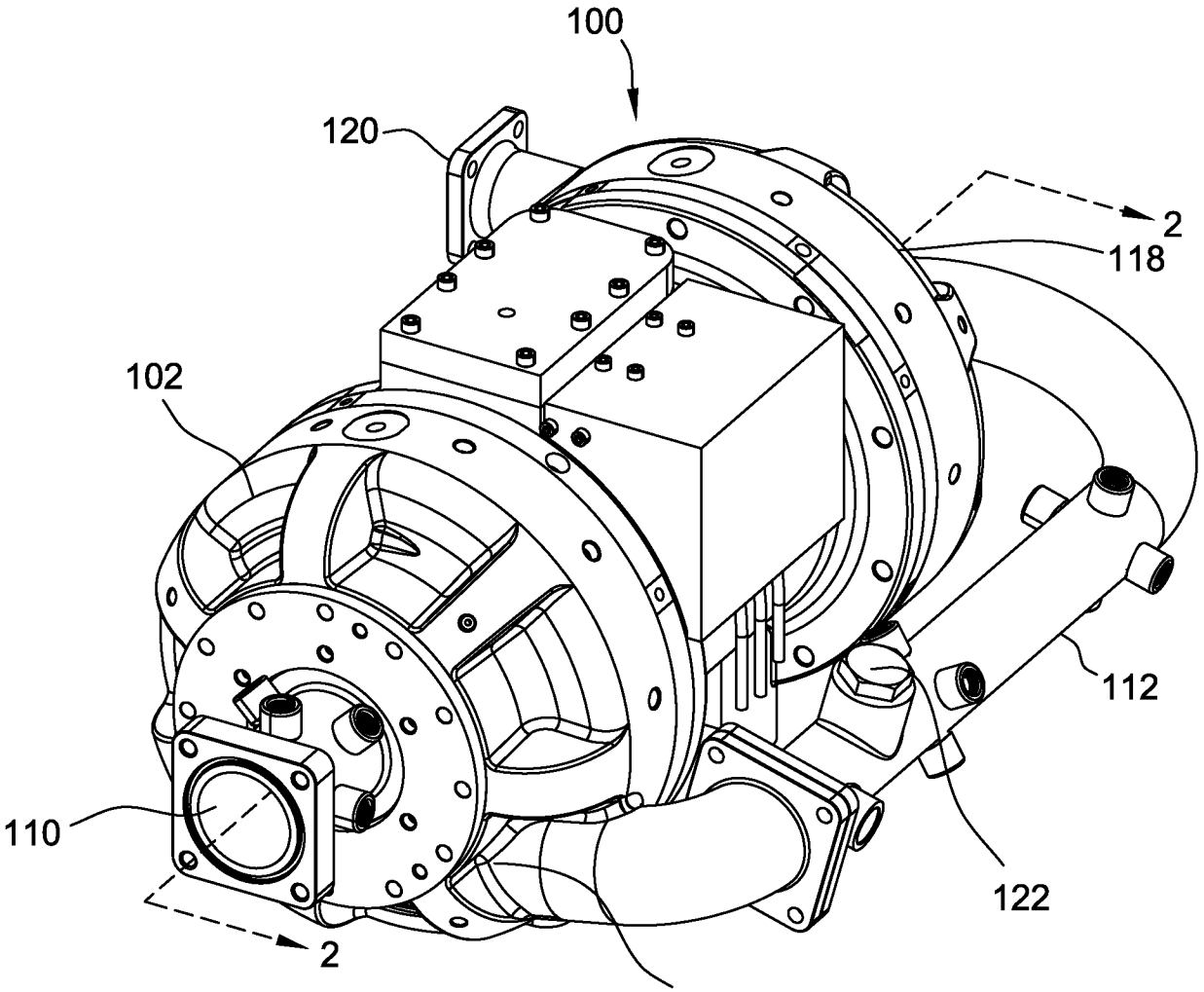
FIG. 1 is a perspective view of an assembled compressor.

Referring to FIG. 1, a compressor illustrated in the form of a two-stage refrigerant compressor is indicated generally at 100. The compressor 100 generally includes a compressor housing 102 forming at least one sealed cavity within which each stage of refrigerant compression is accomplished. The compressor 100 includes a first refrigerant inlet 110 to introduce refrigerant vapor into the first compression stage, a first refrigerant exit 114, a refrigerant transfer conduit 112 to transfer compressed refrigerant from the first compression stage to the second compression stage, a second refrigerant inlet 118 to introduce refrigerant vapor into the second compression stage (not labeled in FIG. 1), and a second refrigerant exit 120. The refrigerant transfer conduit 112 is operatively connected at opposite ends to the first refrigerant exit 114 and the second refrigerant inlet 118, respectively. The second refrigerant exit 120 delivers compressed refrigerant from the second compression stage to a cooling system in which compressor 100 is incorporated. The refrigerant transfer conduit 112 may further include a refrigerant bleed 122 to add or remove refrigerant as needed at the compressor 100.

Figure 2:
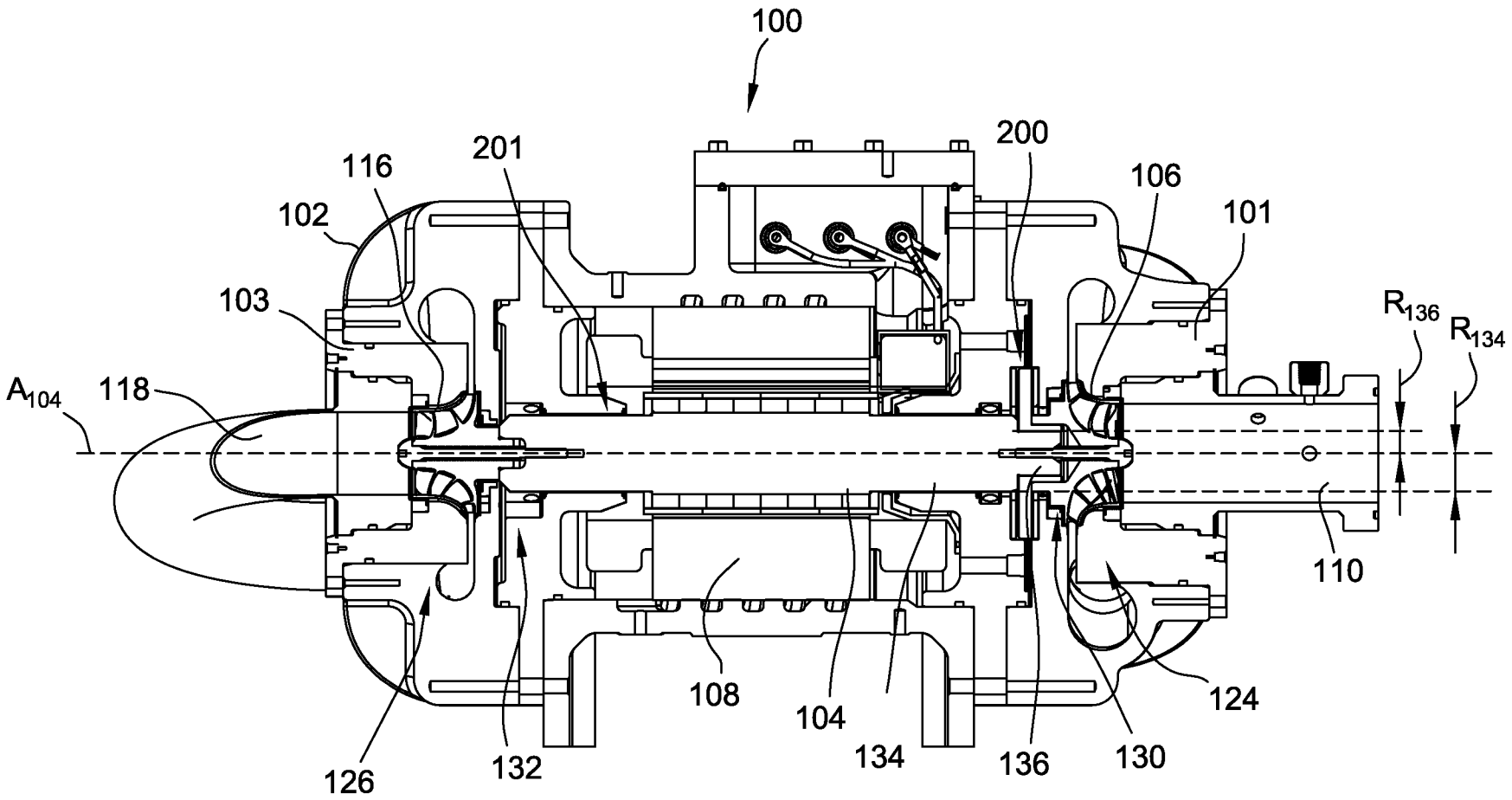
FIG. 2 is a cross-sectional view of the compressor of FIG. 1 taken along line 2-2.

Referring to FIG. 2, the compressor housing 102 encloses a first compression stage 124 and a second compression stage 126 at opposite ends of the compressor 100. The first compression stage 124 includes a first stage impeller 106 configured to impart kinetic energy to incoming refrigerant gas entering via the first refrigerant inlet 110. The kinetic energy imparted to the refrigerant by the first stage impeller 106 is converted to increased refrigerant pressure (i.e. compression) as the refrigerant velocity is slowed upon transfer to a diffuser formed between a first stage inlet ring 101 and a portion of the outer compressor housing 102. Similarly, the second compression stage 126 includes a second stage impeller 116 configured to add kinetic energy to refrigerant transferred from the first compression stage 124 entering via the second refrigerant inlet 118. The kinetic energy imparted to the refrigerant by the second stage impeller 116 is converted to increased refrigerant pressure (i.e. compression) as the refrigerant velocity is slowed upon transfer to a diffuser formed between a second stage inlet ring 103 and a second portion of outer compressor housing 102. Compressed refrigerant exits the second compression stage 126 via the second refrigerant exit 120 (not shown in FIG. 2).

The first stage impeller 106 and second stage impeller 116 are connected at opposite ends of a driveshaft 104 that rotates about a driveshaft axis $A_{104}$. The driveshaft extends from a driveshaft first end 130 to a driveshaft second end 132, and is axisymmetric about the driveshaft axis $A_{104}$. Additionally, the driveshaft axis $A_{104}$ extends through a center of gravity of the driveshaft 104. The driveshaft 104 is operatively connected to a motor 108 positioned between the first stage impeller 106 and second stage impeller 116, such that the motor 108 rotates the driveshaft 104 about the driveshaft axis $A_{104}$. The first stage impeller 106 and the second stage impeller 116 are both coupled to the driveshaft 104 such that the first stage impeller 106 and second stage impeller 116 are rotated at a rotation speed selected to compress the refrigerant to a pre-selected pressure exiting the second refrigerant exit 120. Any suitable motor may be incorporated into the compressor 100 including, but not limited to, an electrical motor.

Figure 3:
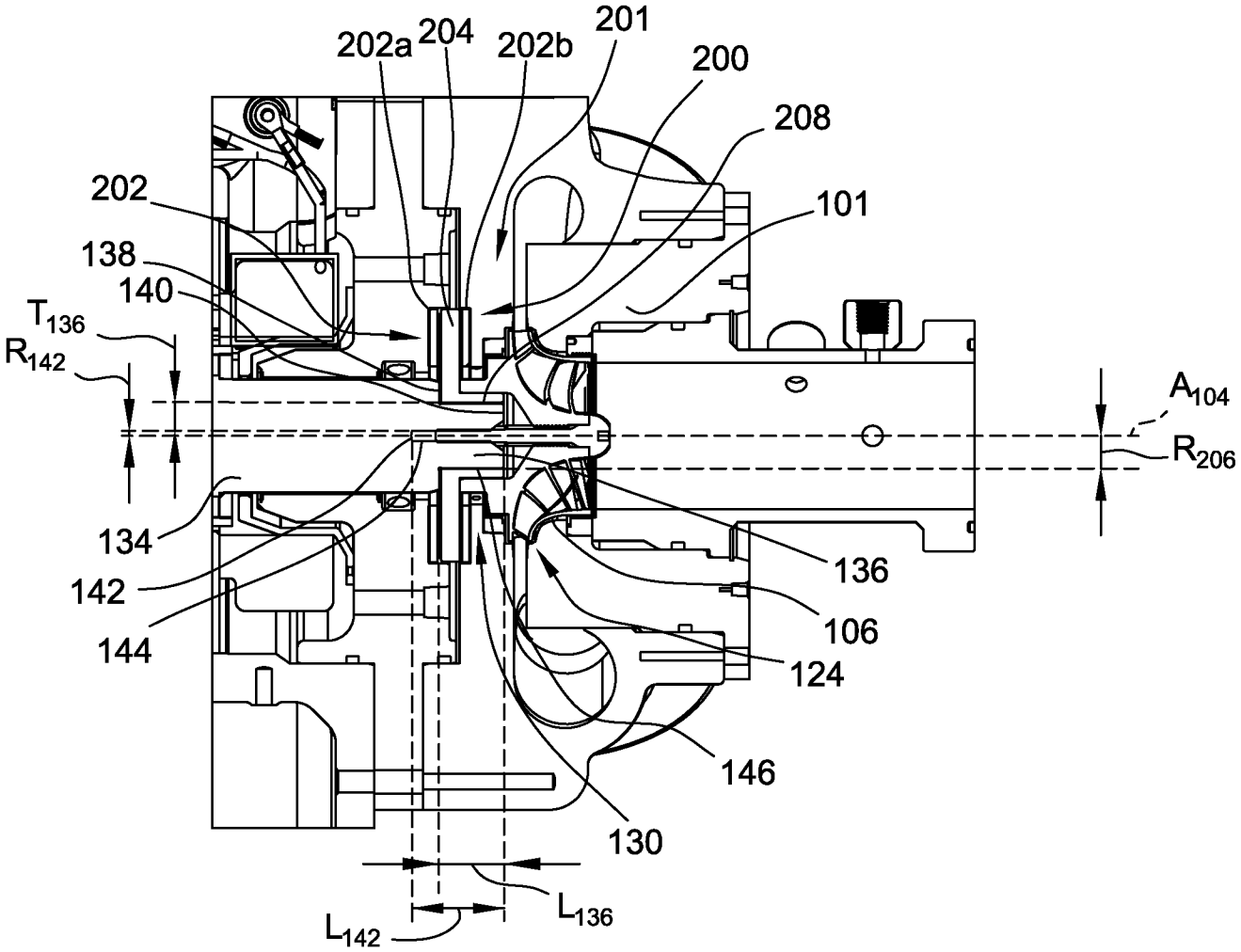
FIG. 3 is an enlarged cross-sectional view of a portion of the compressor of FIG. 2.
Figure 4:
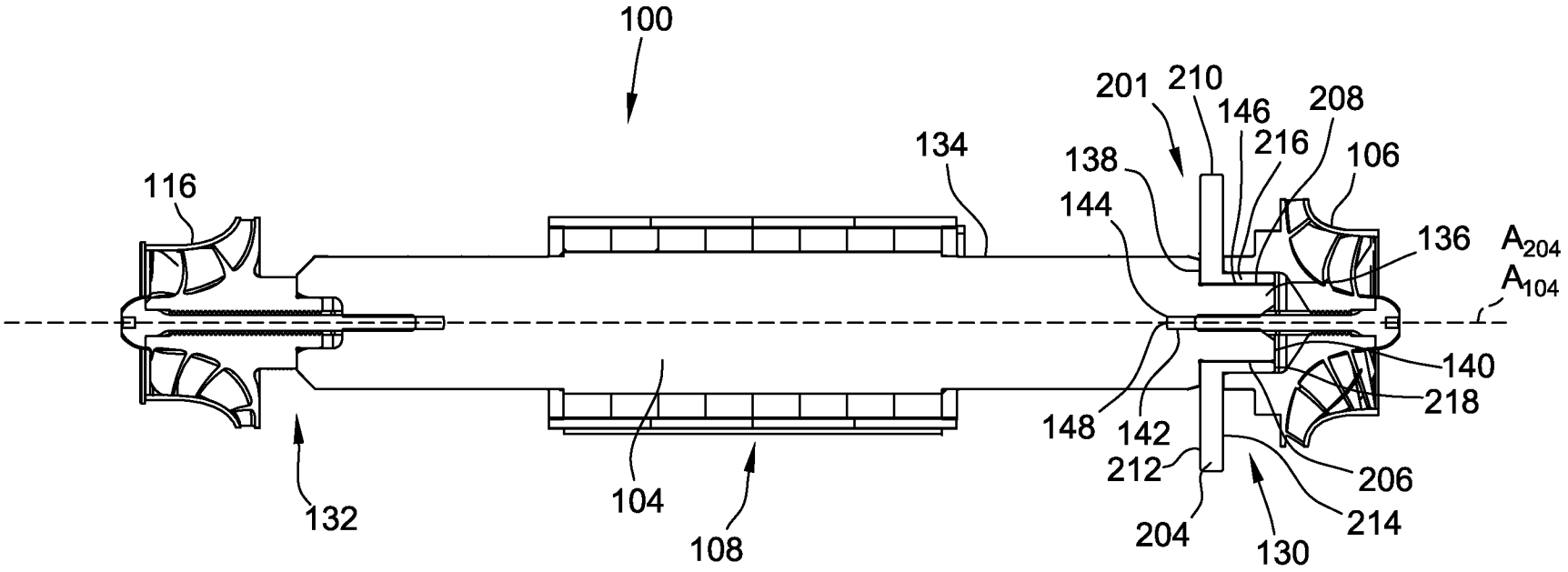
FIG. 4 is a cross-sectional view of a driveshaft assembly of the compressor including a thrust disk and an impeller mounted to an end of a driveshaft.

In reference to FIGS. 2-4, driveshaft 104 includes a first shaft portion 134 having a first shaft portion radius $R_{134}$ and a second shaft portion 136 having a reduced diameter including a second shaft portion radius $R_{136}$, less than the first shaft portion radius $R_{134}$, i.e., the driveshaft 104 includes a step down feature proximate the driveshaft first end 130, in proximity to the first stage impeller 106. The first shaft portion 134 includes first end surface 138 and the second shaft portion 136 includes a second end surface 140, distal to the first end surface 138, disposed on the driveshaft first end 130. The second shaft portion 136 includes a second shaft portion length $L_{136}$ extending between the first end surface 138 and the second end surface 140 along the driveshaft axis $A_{104}$. The driveshaft 104 further includes a blind bore 142 that extends axially inward into the driveshaft 104 from the second end surface 140 to a bore length $L_{142}$ along the driveshaft axis $A_{104}$. That is, the blind bore 142 is co-axial with the driveshaft axis $A_{104}$. In some example embodiments, the bore length $L_{142}$ may be substantially the same length as the length of the second shaft portion $L_{136}$. The bore 142 includes a radius $R_{142}$ extending from the driveshaft axis $A_{104}$ to a bore inner surface 144 that defines the boundary of the blind bore 142. The bore radius $R_{142}$ is less than the second shaft portion radius $R_{134}$, such that the second shaft portion 136 includes an annular wall having a thickness $T_{136}$ extending between the bore inner surface 144 and a second shaft portion outer surface 146. The bore 142 further includes a tapered end 148 (FIG. 4) and a threaded portion defined on the bore inner surface 144.

In reference to FIGS. 2-3, a thrust bearing assembly 200 supports axial forces imparted to the driveshaft 104 during operation of the compressor (e.g., from thrust forces generated by first stage impeller 106 and/or second stage impeller 116). The axial forces are directed generally parallel to the driveshaft axis $A_{104}$. The thrust bearing assembly 200 may include any suitable bearing type, including for example and without limitation, roller-type bearings, fluid film bearings, air foil bearings, and combinations thereof. The thrust bearing assembly 200 includes a bearing bracket 202 that is coupled to the compressor housing 102. The bearing bracket 202 includes a first plate 202*a* and a second plate 202*b* that are separated by a distance and disposed on axially opposite sides of a thrust disk 204 of the thrust bearing assembly 200. The first and second plates 202*a* and 202*b* are annular in shape and include a center opening (not labeled) to receive at least a portion of the driveshaft 104 therein when the compressor 100 is assembled (as shown in FIG. 3). The first and second plates 202*a* and 202*b* may be coupled to the compressor housing 102 using any suitable means including, for example and without limitation, press-fit connections and/or mechanical fasteners. Each of the first and second plates 202*a* and 202*b* may include an inner surface that faces the opposing first plate 202*a* or the second plate 202*b* to support and engage the bearings of the thrust bearing assembly 200.

Figure 5:
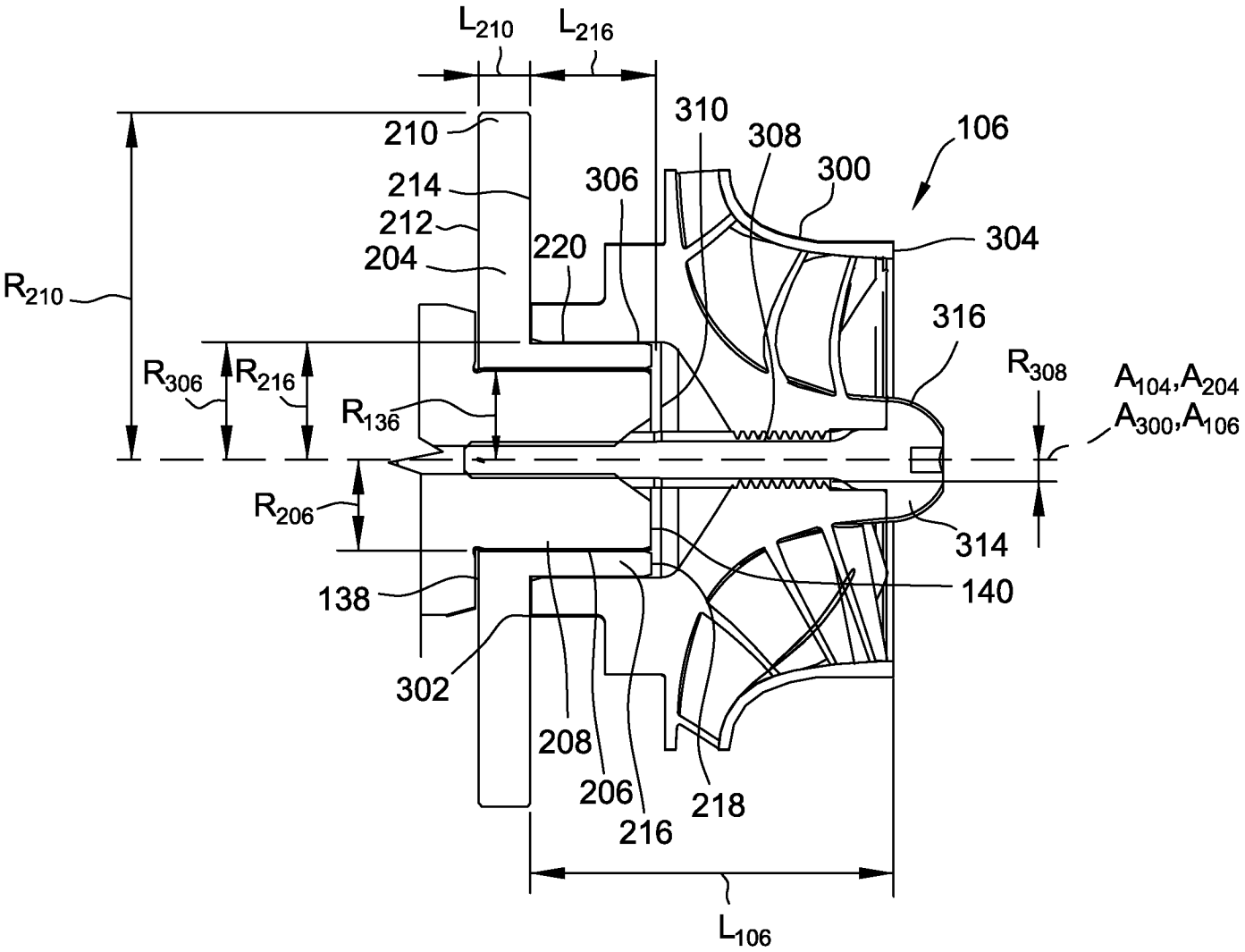
FIG. 5 is an enlarged cross-sectional view of the thrust disk and the impeller mounted to an end of the driveshaft of FIG. 4.
Figure 6:
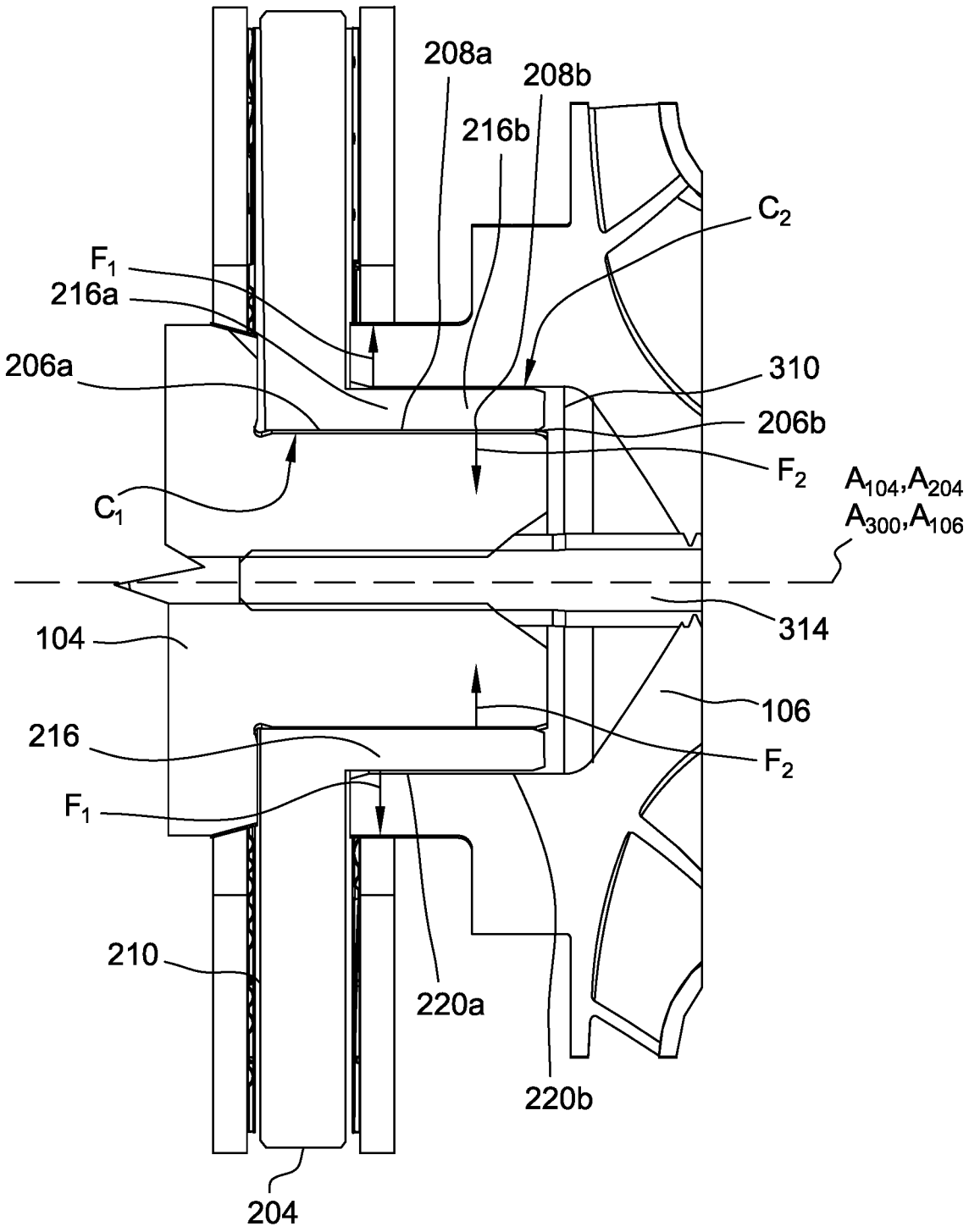
FIG. 6 is an enlarged cross-sectional view of the thrust disk, thrust bearings, and the impeller mounted to the end of the driveshaft of FIG. 5.

Referring to FIGS. 4-6, the thrust disk 204 includes a central hub 216 and an outer disk 210 extending radially outward from the hub 216. The thrust disk 204, specifically the hub 216 in the illustrated embodiment, defines a thrust disk bore 206 and includes a thrust disk bore surface 208 that defines the boundary of the thrust disk bore 206. A thrust disk axis $A_{204}$ extends though the center of gravity of the thrust disk 204, and the thrust disk 204 is axisymmetric about the thrust disk axis $A_{204}$. The thrust disk bore 206 has a radius $R_{206}$ extending from the thrust disk axis $A_{204}$ to the thrust disk bore surface 208. The second shaft portion 136 of the driveshaft 104 projects or extends through the thrust disk bore 206 such that the thrust disk axis $A_{204}$ and the driveshaft axis $A_{104}$ are coincident.

The thrust disk 204 is coupled to the driveshaft 104 by a friction or press fit connection. For example, the thrust disk bore surface 208 is in frictional engagement with the second shaft portion outer surface 146 and the outer disk 210 is in frictional engagement with the first end surface 138 of the driveshaft 104 such that rotation of the driveshaft 104 imparts rotation to the thrust disk 204. The thrust disk bore surface 208 is in contact with the second shaft portion outer surface 146 with limited or no gaps or spaces. Additionally, the radius $R_{206}$ is sized such that there is interference between the thrust disk 204 and the driveshaft 104. In example embodiments, components, such as the thrust disk 204 are coupled to the driveshaft 104, using a press fit, also referred to as interference fit and/or a friction fit. Friction between mating surfaces of the two parts is generated after the two parts having interference are press fit assembled. Based on the amount of interference between thrust disk 204 and the driveshaft 104, the thrust disk 204 may be assembled onto the driveshaft 104 using a hammer or hydraulic ram. In some cases, the components may be assembled using shrink fitting techniques. Shrink fitting techniques are performed by selective heating and/or cooling of the components to be coupled by a shrink fit. In some embodiments, for example, the thrust disk 204 is heated, causing expansion of the thrust disk bore 206 such that the second shaft portion 136 may be inserted and positioned within the expanded thrust disk bore 206. Subsequently, the thrust disk bore 206 shrinks upon cooling of the thrust disk 204 and contracts around the second shaft portion 136. In some embodiments, one or more alignment features or components may be used to assemble mating components, including for example and without limitation, an alignment pin, keyed features, or other features that are engaged between the thrust disk and the driveshaft.

The driveshaft 104, the first stage impeller 106, and the thrust disk 204 are part of a driveshaft assembly 201 of the compressor 100. In the illustrated embodiment, the driveshaft assembly 201 also includes the second stage impeller 116. The driveshaft assembly 201 may include additional or fewer components in other embodiments. In some embodiments, for example, the second stage impeller 116 may be coupled to the second end 132 of the driveshaft 104 by a thrust disk in the same manner as the first stage impeller 106.

In reference again to FIG. 5, the outer disk 210 includes a first disk surface 212 and an opposing second disk surface 214 spaced axially from the first disk surface 212 by a disk length $L_{210}$. The hub 216 extends axially from the second disk surface 214 to a hub end surface 218 for a hub length $L_{216}$. The overall length of the thrust disk 204 includes the disk length $L_{210}$ and the hub length $L_{216}$. In some embodiments, the hub length $L_{216}$ is greater than the disk length $L_{210}$. The outer disk 210 has a disk radius $R_{210}$ measured from the thrust disk axis $A_{204}$ to an outer circumferential surface 219 of the outer disk 210. The hub 216 has a hub radius $R_{216}$ measured from the thrust disk axis $A_{204}$ to a radial outer surface 220 of the hub 216. The outer disk 210 and the hub 216 are formed integrally—i.e., as a unitary member, such as by casting or additive manufacturing. In other embodiments, the outer disk 210 and the hub 216 may be formed separately and coupled together using any suitable means, for example, a welding connection.

The hub radius $R_{216}$ is less than the disk radius $R_{210}$. In the illustrated embodiment, for example, the disk radius $R_{210}$ is about 2-3 times greater than the hub radius $R_{216}$. In other embodiments, the disk radius $R_{210}$ may be greater than or less than 2-3 times greater than the hub radius $R_{216}$. Additionally, the mass of the outer disk 210 is greater than the mass of the hub 216. The centrifugal force is proportional to the mass and the radial distribution of mass. Accordingly, the centrifugal force generated on the outer disk 210 is greater than a centrifugal force generated on the hub 216 during high-speed rotation of driveshaft 104. In some embodiments, the centrifugal force on the outer disk 210 is much greater than the centrifugal force on the hub 216.

The radius $R_{206}$ of the thrust disk bore 206 is less than the first radius $R_{134}$ (FIG. 2) of the first shaft portion 134. At least a portion of the first disk surface 212 is in contact with the first end surface 138 of the first shaft portion 134. Additionally, the outer disk radius $R_{210}$ is greater than the first shaft portion radius $R_{134}$ such that a portion of the outer disk 210 extends radially outward from the first shaft portion 134. The thrust disk 204 is shaped such that the cross-section of the thrust disk 204 about a plane passing through the thrust disk axis $A_{204}$, yields a generally "L-Shaped" profile arranged on each side of the second shaft portion 136. The outer disk 210 extends away from the driveshaft 104, such that at least a portion of the outer disk 210 is disposed between the first plate 202*a* and the second plate 202*b* of the bearing bracket 202. The first disk surface 212 is disposed toward (i.e., facing) the first plate 202*a* and the second disk surface 214 is disposed toward (i.e., facing) the second plate 202*b*. Suitable bearings are supported by the first and second plate 202*a*, 202*b* and are rotationally engaged with the outer disk 210, such that the outer disk 210 may rotate relative to the first plate 202*a* and the second plate 202*b*.

Figure 7:
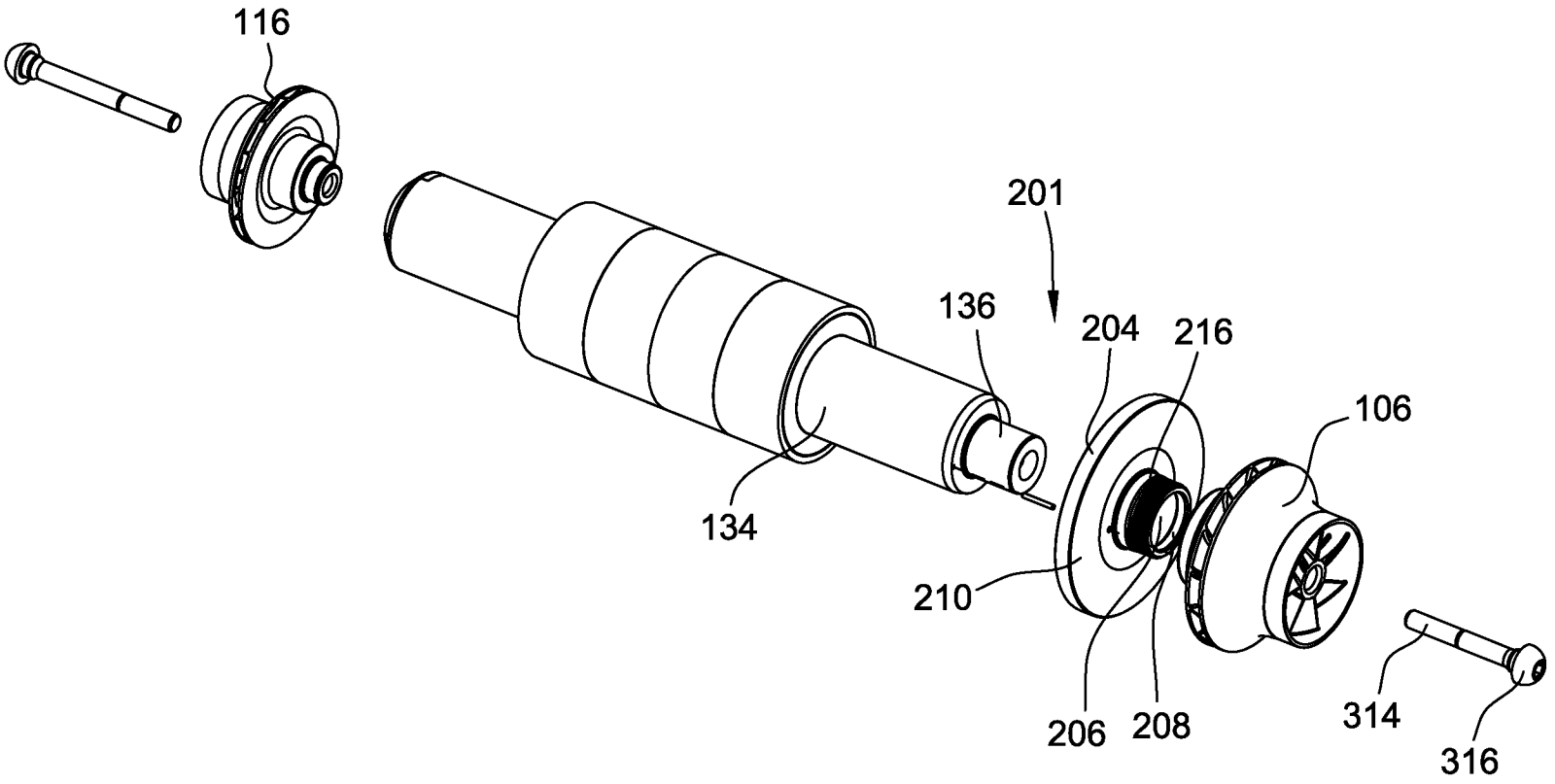
FIG. 7 is an exploded view of the driveshaft assembly of FIG. 4 including the thrust disk, the impeller, and the driveshaft.

In reference to FIGS. 5-7, the first stage impeller 106 extends a length $L_{106}$ along an impeller axis $A_{106}$ between an impeller first end 302 and an impeller second end 304. Impeller axis $A_{106}$ extends through the center of gravity of the impeller 106. The impeller 106 is axisymmetric, i.e., symmetric about the impeller axis $A_{106}$. The impeller 106 further includes a first impeller bore 306 extending axially into the impeller 106 from the impeller first end 302, and a second impeller bore 308 extending axially into the impeller 106 from the impeller second end 304. The first impeller bore 306 has a radius $R_{306}$, and the second impeller bore 308 has a radius $R_{308}$. The radius $R_{306}$ is greater than $R_{308}$. The first impeller bore 306 and the second impeller bore 308 are arranged such that they collectively form an opening that passes entirely through the impeller 106 from the impeller second end 304 to the impeller first end 302. The impeller 106 further includes a plurality of vanes and may include a shroud. The impeller 106 may include any suitable type of vanes that are employed to impart kinetic energy to incoming refrigerant.

The first impeller bore 306 includes an impeller inner surface 310 that defines the boundary of the first impeller bore 306. The hub 216 of the thrust disk 204 is disposed within the first impeller bore 306 of the impeller 106, such that the impeller axis $A_{106}$ is coincident with both the thrust disk axis $A_{204}$ and the driveshaft axis $A_{104}$. The hub 216 is press fit within the first impeller bore 306 such that the outer surface 220 is frictionally connected with the impeller inner surface 310 with minimal gaps or spaces. In some example embodiments, the hub 216 may be frictionally connected with the first impeller bore 306 using shrink fitting techniques. Accordingly, rotation of the driveshaft 104 results in rotation of the thrust disk 204 and the impeller 106. The thrust disk 204 transmits torque from the driveshaft 104 to the impeller 106 and, as such, the impeller 106 is not directly mounted to the driveshaft 104. The thrust disk 204 and the impeller 106 are arranged relative to the driveshaft 104 such that the center of gravity of the thrust disk 204 and the impeller 106 are aligned with the driveshaft axis $A_{104}$. In other words, the driveshaft axis $A_{104}$, thrust disk axis $A_{204}$, and the impeller axis $A_{106}$ are all co-axial. Furthermore, the assembly of the driveshaft 104, the thrust disk 204, and the impeller 106 is axisymmetric about the driveshaft axis $A_{104}$.

Referring again to FIG. 6, in some example embodiments, the hub 216 includes a first hub portion 216*a* extending from the outer disk 210, and a second hub portion 216*b* extending from the first hub portion 216*a*. The first hub portion 216*a* includes a first outer surface 220*a* and a first inner surface 208*a* defining a first portion 206*a* of the thrust disk bore 206. The first hub portion 216*a* has an inner hub radius (not shown) measured from the thrust disk axis $A_{204}$ to the first inner surface 208*a* and an outer radius (not shown) measured from the thrust disk axis $A_{204}$ to the first outer surface 220*a*. The second hub portion 216*b* includes a second outer surface 220*b* and a second inner surface 208*b* defining a second portion 206*b* of the thrust disk bore 206. The second hub portion 216*b* includes an inner hub radius (not shown) measured from the thrust disk axis $A_{204}$ to the second inner surface 208*b* and an outer radius (not shown) measured from the thrust disk $A_{204}$ to the second outer surface 220*b*. The outer radius of the second hub portion 216*b* is less than the outer radius of the first hub portion 216*a*, such that there is a greater interference (i.e., a tighter fit) between the first outer surface 220*a* and the impeller inner surface 310 compared to the interference between the second outer surface 220*b* and impeller inner surface 310. In some embodiments, there may be a clearance or gap $C_2$ between the second outer surface 220*b* and the impeller inner surface 310. For example, the clearance $C_2$ may be between 0.1 to 1 millimeters (mm). The second outer surface 220*b* of the second hub portion 216*b* may include threads that may facilitate removal of the thrust disk 204 from the driveshaft 104 during disassembly.

The inner radius of the second hub portion 216*b* may be smaller than the inner radius of the first hub portion 216*a*, such that the second inner surface 208*b* has greater interference (i.e., a tighter fit) with the driveshaft 104 compared with the interference between the first inner surface 208*a* and the driveshaft 104. In some embodiments, there may be a clearance or gap $C_1$ between the first inner surface 208*a* and the driveshaft 104. For example, the clearance $C_1$ between the first inner surface 208*a* and the driveshaft 104 may be between 0.1 and 1 (mm).

Rotation of the driveshaft 104, the thrust disk 204, and the impeller 106 induce centrifugal forces directed in an outward radial direction, perpendicular to the driveshaft axis $A_{104}$. The induced centrifugal forces increase with increased rotational speed squared. The centrifugal force is an inertial force that is proportional to the radial distribution of mass about the axis of rotation, i.e., the driveshaft axis $A_{104}$. The outer disk 210 has a larger radius $R_{210}$ compared with the hub radius $R_{216}$ of the hub 216. Accordingly, the outer disk 210 experiences a greater centrifugal force compared to the centrifugal force experienced by the hub 216. The centrifugal force on the outer disk 210 pulls the outer disk 210 in a radial direction, perpendicular to the driveshaft axis $A_{104}$, away from the driveshaft 104. The centrifugal force on the outer disk 210 also exerts an outward radial force on the first hub portion 216*a* which is proximate to the outer disk 210. The outward radial force exerted on the first hub portion 216*a*, causes the first outer surface 220*a* of the first hub portion 216*a* to exert a force against the impeller inner surface 310, referred to as a first contact force $F_1$, thereby increasing the frictional connection between the first outer surface 220*a* and the impeller inner surface 310. The first contact force $F_1$ increases with increased rotational speed of the driveshaft 104, and provides sufficient contact force to maintain the friction connection between the hub 216 and the impeller 106 and to maintain the alignment of the center of gravity of the impeller 106 and the center of gravity of the thrust disk 204 at high-rotational operation speeds.

The centrifugal force on the second hub portion 216*b* pulls the second hub portion 216*b* radially outward away from the driveshaft 104. The centrifugal force on the outer disk 210 and the first hub portion 216*a* may cause the second hub portion 216*b* to flex, slightly, in a radially inward direction, towards the driveshaft 104. In some embodiments, the friction fit between the second hub portion 216*b* and the driveshaft 104 may decrease with increased rotational speed of the driveshaft 104. The contact force $F_2$ between the second inner surface 208*b* of the second hub portion 216*b* and the driveshaft 104 is sufficient to maintain the friction connection between the thrust disk 204 and the driveshaft 104 and the alignment of the center of gravity of thrust disk 204 with the driveshaft axis $A_{104}$ at normal operational speeds of the driveshaft 104. In other words, as the rotational speed of the driveshaft 104 increases, the interference fit or connection between the thrust disk 204 and the driveshaft 104 may decrease slightly and the connection between the thrust disk 204 and the impeller 106 becomes stronger (i.e., tighter). The friction fit or connection between the thrust disk 204 and the driveshaft 104 prevents slipping or relative movement between the thrust disk 204 and the driveshaft 104, and. enables the transfer of torque from the driveshaft 104 to the thrust disk 204 and, consequently, from the driveshaft 104 to the impeller 106.

The impeller 106 further includes a screw 314 that extends through the second impeller bore 308 and the first impeller bore 306, and into the blind bore 142 of the driveshaft 104. The screw 314 includes a threaded portion having threads that are engaged with threads defined on the bore inner surface 144 (not shown). The screw 314 includes a head 316 that is engaged with the impeller second end 304. When the screw 314 is tightened, the screw 314 compresses the impeller 106 against the thrust disk 204, thereby facilitating transmission of torque from the thrust disk 204 to the impeller 106. More specifically, the screw 314 forces the impeller first end 302 into contact with the second disk surface 214 of the thrust disk 204 thereby causing a portion of the outer disk 210 to be compressed between the impeller first end 302 and the first end surface 138 of the driveshaft 104. Tightening of the screw 314 generates a clamping force on the thrust disk 204. The threads of the screw 314 are arranged such that rotation of the driveshaft 104 does not loosen or unscrew the threads of the screw 314 with the threads of the blind bore 142.

Accordingly, in the embodiments illustrated in this disclosure, the thrust disk 204, the impeller 106, and the driveshaft 104 are arranged such that the frictional connections or fits between the components are generally maintained at operational rotational speeds of the driveshaft 104. The frictional fit between the driveshaft 104 and the thrust disk 204 may decrease slightly with increased rotational speed of the driveshaft 104. The decrease in friction fit between the driveshaft 104 and the thrust disk 204 is not highly dependent on the rotational speed of the driveshaft 104. Further, increases in the rotational speed of the driveshaft 104 may increase the frictional connection between the thrust disk 204 and the impeller 106. More specifically, increases in the rotational speed of the driveshaft 104 increases the first contact force $F_1$ between the hub 216 and the impeller 106 and only slightly decreases the second contact force $F_2$ between the hub 216 and the driveshaft 104. The first and second contact forces $F_1$, $F_2$ are sufficient to maintain frictional connection between the assembled components. Furthermore, the assembly of the components is such that the center of gravity of the thrust disk 204 and the impeller 106 are coincident with the axis of rotation, limiting eccentric loading at high-rotational speeds.

Embodiments of the systems and methods described achieve superior results as compared to prior systems and methods associated with thrust bearing assemblies. The thrust disk, impeller, and driveshaft assembly facilitate maintaining alignment of the rotating components at high-rotational operating speeds consistent with compressor systems. The high-rotational operating speeds of the driveshaft increase friction fit connections between the thrust disk and the impeller, and maintain the friction fit connection between the thrust disk and the driveshaft. In some embodiments, the impeller is not directly coupled to the driveshaft, and torque is transmitted from the driveshaft to the impeller through the thrust disk. The improved friction fit connection maintains the alignment between the center of gravity of the thrust disk, the impeller, and the driveshaft with the axis of rotation. The disclosed assemblies are compatible with centrifugal compressors, which typically operate at high rotational speeds. The assembly of the components described herein may be incorporated into the design of any type of centrifugal compressors. Non-limiting examples of centrifugal compressors suitable for use with the disclosed system include single-stage, two-stage, and multi-stage centrifugal compressors. Additionally, the described assembly is well suited for other applications including other mechanical systems having components, such as an impeller and bearing assemblies coupled to a high-rotational speed driveshaft.

Unlike known bearing systems and impellers mounted to a driveshaft of compressor systems, the thrust disk, impeller, and driveshaft assembly described in this disclosure enables the alignment of the center of gravities of the components as well as maintaining of friction fit connections, regardless of the high-rotational operation speed of the driveshaft, both of which are important factors in the successful implementation of centrifugal compressors as discussed above. Furthermore, the high-rotational speeds serve to improve the friction fit between the thrust disk and the impeller, maintaining friction connections and preventing eccentric loads on the driveshaft. The described assembly may result in improved operational lifespan while reducing wear of components thereby lowering costs associated with repair and downtime of rotational machines. The assembly described provides enhanced features increasing the working life and durability of impeller, thrust disk, and driveshaft for use in the challenging operating environment of refrigerant compressors of HVAC systems.

Example embodiments of compressor systems and methods, such as refrigerant compressors, are described above in detail. The systems and methods are not limited to the specific embodiments described herein, but rather, components of the system and methods may be used independently and separately from other components described herein. For example, the impeller and thrust disk described herein may be used in compressors other than refrigerant compressors, such as turbocharger compressors and the like.

When introducing elements of the present disclosure or the embodiment(s) thereof, the articles "a", "an", "the" and "said" are intended to mean that there are one or more of the elements. The terms "comprising," "including," "containing" and "having" are intended to be inclusive and mean that there may be additional elements other than the listed elements. The use of terms indicating a particular orientation (e.g., "top", "bottom", "side", etc.) is for convenience of description and does not require any particular orientation of the item described.

As various changes could be made in the above constructions and methods without departing from the scope of the disclosure, it is intended that all matter contained in the above description and shown in the accompanying drawing(s) shall be interpreted as illustrative and not in a limiting sense.

What is claimed is:

1. A compressor system comprising:

a compressor housing;

a driveshaft rotatably supported within the compressor housing;

an impeller that imparts kinetic energy to incoming refrigerant gas upon rotation of the driveshaft, wherein the impeller includes an impeller bore having an inner surface;

a thrust disk coupled to the driveshaft, the thrust disk including an outer disk and a hub, the hub disposed within the impeller bore, wherein the hub includes a hub outer surface in contact with the inner surface of the impeller bore, and wherein the thrust disk defines a thrust disk bore having a bore inner surface in contact with the driveshaft, and wherein a first contact force between the hub outer surface and the inner surface of the impeller bore increases with increased rotational speed of the driveshaft and wherein the bore inner surface flexes radially inward toward the driveshaft with increased rotational speed of the driveshaft creating a second contact force between the bore inner surface and the driveshaft; and a bearing assembly mounted to the compressor housing, the bearing assembly rotatably supporting the outer disk of the thrust disk.

2. The compressor system of claim 1, wherein the driveshaft is press fit within the thrust disk bore.

3. The compressor system of claim 2, wherein a friction connection between the bore inner surface and the driveshaft is maintained during operational rotational speed of the driveshaft.

4. The compressor system of claim 3, wherein the bore inner surface includes a first bore inner surface proximate the outer disk and a second bore inner surface distal from the outer disk, wherein the second contact force is between the second bore inner surface and the driveshaft.

5. The compressor system of claim 1, wherein the hub outer surface includes a first portion proximate the outer disk and a second portion distal to the outer disk, wherein the first contact force is between the first portion of the hub outer surface and the inner surface of the impeller bore.

6. The compressor system of claim 1, wherein the driveshaft includes an inner blind bore, the inner blind bore including a bore threaded portion.

7. The compressor system of claim 6 including a screw disposed within the impeller bore and the inner blind bore of the driveshaft, wherein the screw includes a screw threaded portion that is threadably engaged with the bore threaded portion.

8. The compressor system of claim 7, wherein rotation of the driveshaft does not disengage the screw threadably engaged with the bore threaded portion.

9. The compressor system of claim 1, wherein the outer disk includes an outer disk radius and an outer disk moment of inertia, and wherein the hub includes a hub radius and a hub moment of inertia, wherein the outer disk radius and the outer disk moment of inertia are greater than the hub radius and the hub moment of inertia.

10. The compressor system of claim 1, wherein the impeller is not directly coupled to the driveshaft.

11. A driveshaft assembly for a compressor, the driveshaft assembly comprising:

a driveshaft;

a thrust disk coupled to a driveshaft and including an outer disk and hub, wherein the hub includes a hub outer surface, and wherein the thrust disk defines a thrust disk bore having a bore inner surface in contact with the driveshaft; and an impeller coupled to the thrust disk, the impeller including an impeller bore having an inner surface;

wherein the hub of the thrust disk is disposed within the impeller bore, and wherein the hub outer surface is in contact with the inner surface of the impeller bore, and wherein a first contact force between the hub outer surface and the inner surface of the impeller bore increases with increased rotational speed of the driveshaft and wherein the bore inner surface flexes radially inward toward the driveshaft with increased rotational speed of the driveshaft creating a second contact force between the bore inner surface and the driveshaft.

12. The driveshaft assembly of claim 11, wherein the driveshaft is press fit within the thrust disk bore.

13. The driveshaft assembly of claim 12, wherein a friction connection between the bore inner surface and the driveshaft is maintained during operational rotational speed of the driveshaft.

14. The driveshaft assembly of claim 13, wherein the bore inner surface includes a first bore inner surface portion proximate the outer disk and a second bore inner surface portion distal to the outer disk, wherein the second contact force is between the second bore inner surface portion and the driveshaft.

15. The driveshaft assembly of claim 11, wherein the hub outer surface includes a first hub portion proximate to the outer disk and a second hub portion distal to the outer disk, wherein the first contact force is between the first hub portion of the hub outer surface and the inner surface of the impeller bore.

16. The driveshaft assembly of claim 11, wherein the driveshaft includes an inner blind bore, the inner blind bore including a bore threaded portion.

17. The driveshaft assembly of claim 16 including a screw disposed within the impeller bore and the inner blind bore of the driveshaft, wherein the screw includes a screw threaded portion that is threadably engaged with the bore threaded portion.

18. The driveshaft assembly of claim 11, wherein the outer disk includes an outer disk radius and an outer disk moment of inertia, and wherein the hub includes a hub radius and a hub moment of inertia, wherein the outer disk radius and the outer disk moment of inertia is greater than hub radius and the hub moment of inertia.

19. The driveshaft assembly of claim 11, wherein the impeller is not directly coupled to the driveshaft.

20. A method of assembling a compressor, the method comprising:

coupling a thrust disk to a driveshaft by inserting the driveshaft into a thrust disk bore having a bore inner surface, such that the bore inner surface is in contact with the driveshaft;

coupling an impeller to the thrust disk by inserting a hub of the thrust disk into an impeller bore of the impeller such that an outer surface of the hub is in contact with an inner surface of the impeller bore and a first contact force between the hub outer surface and the inner surface of the impeller bore increases with increased rotational speed of the driveshaft and wherein the bore inner surface flexes radially inward toward the driveshaft with increased rotational speed of the driveshaft creating a second contact force between the bore inner surface and the driveshaft; and mounting bearings to a compressor housing such that the bearings rotatably support an outer disk of the thrust disk.

* * * * *